United States Patent [19]

Watanabe et al.

[11] Patent Number: 4,646,055

[45] Date of Patent: Feb. 24, 1987

[54] ROTARY TRIMMER POTENTIOMETER

[75] Inventors: Hiroyuki Watanabe; Fumitoshi Masuda, both of Fukui, Japan

[73] Assignee: Murata Manufacturing Co., Ltd., Japan

[21] Appl. No.: 770,853

[22] Filed: Aug. 29, 1985

[30] Foreign Application Priority Data

Sep. 1, 1984 [JP] Japan ..... 59-183498
Sep. 1, 1984 [JP] Japan ..... 59-183499
Sep. 1, 1984 [JP] Japan ..... 59-183500

[51] Int. Cl.[4] ..... H01C 10/32

[52] U.S. Cl. ..... 338/162; 338/174; 338/DIG. 1

[58] Field of Search ..... 338/162, 174, 171, 160, 338/161, 163, 164, 167, 184, 199, DIG. 1

[56] References Cited

U.S. PATENT DOCUMENTS 3,446,085 5/1969 Ginsberg ..... 338/174 X
3,596,223 7/1971 Stuckey ..... 338/174
3,982,220 9/1976 Rozema et al. ..... 338/174
4,004,264 1/1977 Hogue et al. ..... 338/174
4,114,132 9/1978 DeRoven et al. ..... 338/174
4,427,966 1/1984 Gratzinger et al. ..... 338/162

*Primary Examiner*—E. A. Goldberg
*Assistant Examiner*—M. M. Lateef
*Attorney, Agent, or Firm*—Ostrolenk, Faber, Gerb & Soffen

[57] ABSTRACT

A potentiometer comprises a housing having a resistance element disposed therewithin, a spur gear rotatably housed within the housing and drivingly engaged with a worm gear that is rotatably supported by the housing for rotating the spur gear when such worm gear is externally turned. A resilient wiper assembly carried by the spur gear for rotation therewith sweeps the resistance element and applies a resilient force to the spur gear to urge the latter in a direction away from the resistance element. The spur gear has a toothless area defined at a portion of the toothed periphery thereof which corresponds in position to one end of the resistance element. The toothless area has a tapered face engageable with the worm gear to displace the spur gear in the opposite direction against the resiliency of the wiper assembly when the wiper means is brought to the end of the resistance element wherefore the spur gear can be disengaged from the worm gear.

3 Claims, 26 Drawing Figures

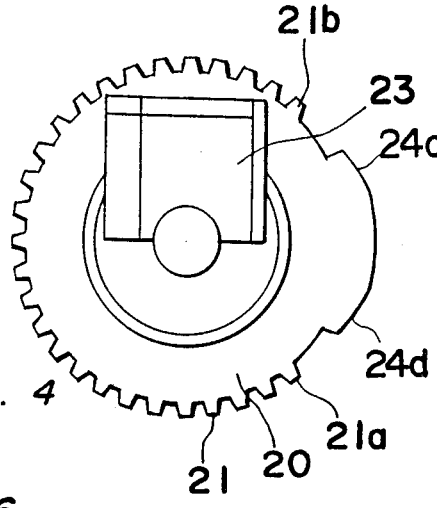
Fig. 4
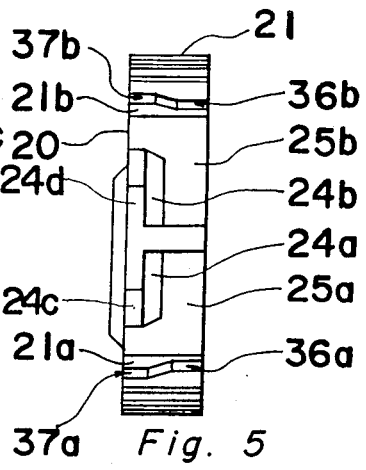
Fig. 5
Fig. 6
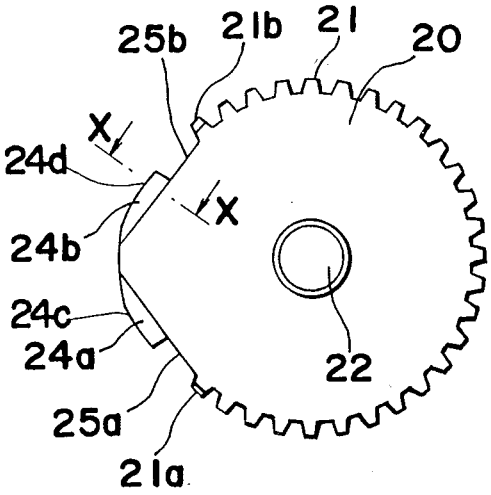
Fig. 7
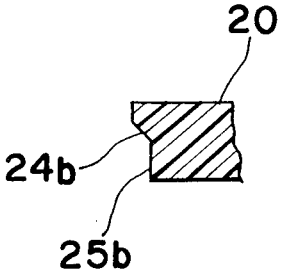
Fig. 8a
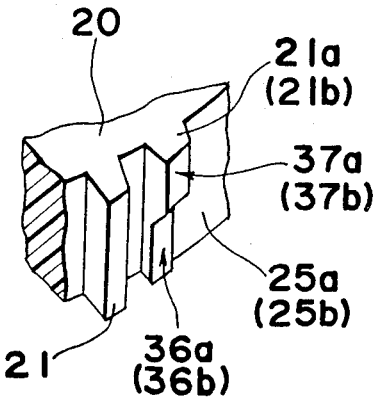
Fig. 8b
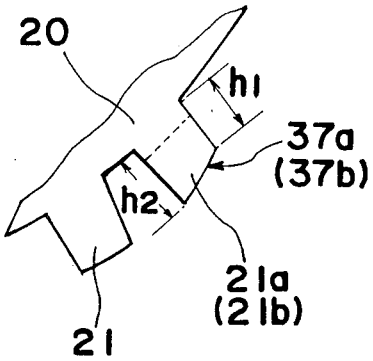

ROTARY TRIMMER POTENTIOMETER

BACKGROUND OF THE INVENTION

The present invention relates to a rotary trimmer potentiometer having a gear mechanism for the fine adjustment of the resistance and, more particularly, to a clutch mechanism used in the trimmer potentiometer.

In a rotary trimmer potentiometer including a worm gear rotatably supported in a housing in engagement with a spur gear, rotatably disposed within the housing, for rotating the spur gear when the worm gear is externally turned, and a wiper carried by the spur gear for rotation together therewith for sweeping the resistance element in contact therewith during the rotation of the spur gear, the provision of a clutch mechanism is required for interrupting the transmission of a rotational force from the worm gear to the spur gear only when the wiper rotating together with the spur gear is brought to one of the opposite ends of the resistance element, while permitting the worm gear to be turned idle without rotating the spur gear further.

The prior art clutch mechanism is disclosed in, for example, U.S. Pat. No. 3,099,810 patented July 30, 1963, some of the drawings of which are herein reproduced as FIGS. 11 and 12 for the purpose of discussion of the prior art considered most pertinent to the present invention.

Referring now to FIGS. 11 and 12, the spur gear 2 employed in the prior art potentiometer and having teeth 3 is formed with a blank base 4 by removing some of the teeth 3. A generally ring-shaped ratchet spring member 5 having a stopper projection 8 and a pair of opposite elastically yieldable clutch pawls 6 and 7 substantially functioning as dummy teeth is positioned on one side of the spur gear 2 with the elastically yieldable clutch pawls 6 and 7 arranged radially outwardly of the spur gear 2 adjacent the blank base 4. The clutch pawls 6 and 7, when not deformed, lie in approximately the same position as normal teeth adjacent the respective end teeth of the spur gear 2 confronting the blank base 4.

The prior art potentiometer utilizing the clutch mechanism of the above described construction is so designed and so operable that, when the worm gear 1 is rotated in one direction shown by the arrow A2 to rotate the spur gear 2 in a direction shown by the arrow B2 and when the wiper rotatable together with the spur gear 2 is subsequently brought to one end of the resistance element with the stopper projection 8 abutting against a stopper boss rigid with the potentiometer housing, the end tooth, identified by 3a, of the spur gear can have just moved beyond the teeth of the worm gear 1 and, therefore, further rotation of the worm gear 1 in the direction A2 can cause the associated clutch pawl 7 to bend from its normal position shown by the phantom line and then spring back to its former position. However, when the worm gear 1 is rotated in a direction A1 counter to the direction A2, a force can be applied from the adjacent tooth of the worm gear 1 to the clutch pawl 7 in a direction required to cause the spur gear 2 to rotate in a direction B1 counter to the direction B2. The clutch pawl 6 functions in a manner similar to the clutch pawl 7 when the wiper is brought to the opposite end of the resistance element as a result of the rotation in the direction B1.

The prior art potentiometer appears to be costly in view of the fact that the ratchet spring member which is separate from the spur gear is employed and, therefore, the method of fabricating it is relatively complicated. Moreover, there is a relatively great possibility that the ratchet spring member will not be properly positioned relative to the spur gear, and once the ratchet spring member fails to be properly positioned, the potentiometer as a whole will be rejected.

SUMMARY OF THE INVENTION

The present invention has been devised with a view to substantially eliminating the disadvantages and inconveniences inherent in the prior art potentiometer and has for its essential object to provide an improved potentiometer which can be manufactured with a minimized number of component parts and is therefore inexpensive, but reliable in performance.

In order to accomplish this object of the present invention, an improved potentiometer herein disclosed comprises a housing having a resistance element disposed therewithin, a spur gear rotatably housed within the housing and drivingly engaged with a worm gear that is rotatably supported by the housing for rotating the spur gear when such worm gear is externally turned, and a resilient wiper means carried by the spur gear for rotation together therewith for sweeping the resistance element in contact therewith and applying a resilient force to the spur gear to urge the latter in one direction away from the resistance element. The spur gear has a toothless area defined at a portion of the toothed periphery thereof which corresponds in position to one end of the resistance element.

The toothless area has a tapered face engageable with the worm gear to displace the spur gear in the opposite direction against the resiliency of the wiper means when the wiper means is brought to the end of the resistance element wherefore the spur gear can be disengaged from the worm gear. Thus, when and after the spur gear is displaced in the opposite direction against the resiliency of the wiper means, the rotational force of the worm gear will no longer be transmitted to the spur gear and the spur gear can be held still, regardless of the further rotation of the worm gear, at a position where the wiper means is held in engagement with the end of the resistance element.

The turn of the worm gear in a direction reverse to the direction necessary for the wiper means to be brought to the end of the resistance element results in the return of the spur gear by the resiliency of the wiper means and the subsequent rotation of the spur gear in the reverse direction with the teeth of the spur gear successively engaged with the teeth of the worm gear.

BRIEF DESCRIPTION OF THE DRAWINGS

This and other objects and features of the present invention will become clear from the following description taken in conjunction with a preferred embodiment thereof with reference to the accompanying drawings, in which:

FIG. 4 is a bottom plan view, on an enlarged scale, of a spur gear used in the potentiometer;

FIG. 5 is a side elevational view of the spur gear;

FIG. 6 is a top plan view, on an enlarged scale, of the spur gear;

FIG. 7 is a cross-sectional view taken along the line X—X in FIG. 6;

FIG. 8*a* is a perspective view, on a further enlarged scale, of a portion of the spur gear showing the details of one of the opposite end teeth thereof;

FIG. 8*b* is a bottom view of the portion of the spur gear shown in FIG. 8*a;*

DETAILED DESCRIPTION OF THE EMBODIMENT

Figure 1:
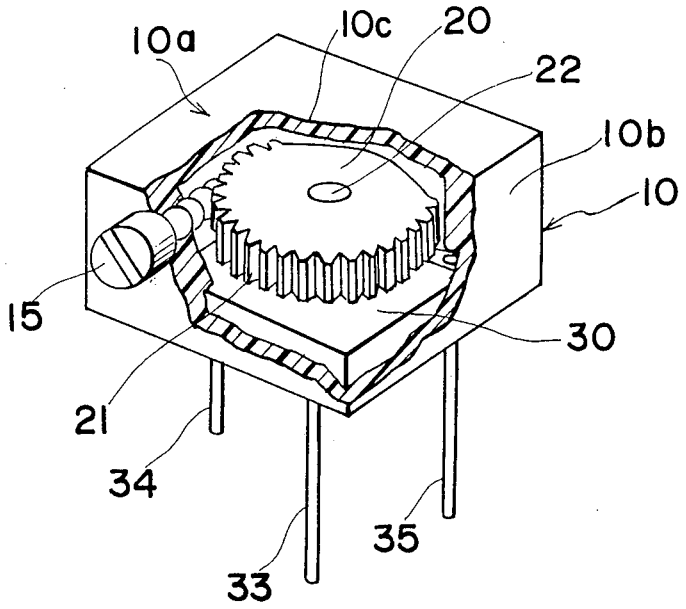
FIG. 1 is a perspective view, with a portion cut away, of a potentiometer embodying the present invention.
Figure 2:
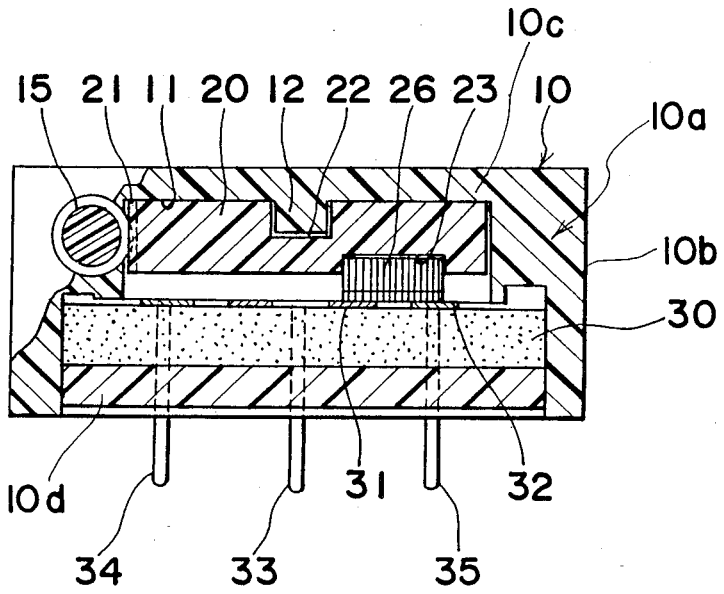
FIG. 2 is a side sectional view, on an enlarged scale, of the potentiometer.

Referring first to FIGS. 1 and 2, a trimmer potentiometer embodying the present invention includes a substantially rectangular housing 10 made of synthetic resin and constituted by a generally cup-like housing member 10*a*, having a peripheral wall 10*b* and a top wall 10*c*, and a base member 10*d*. The base member 10*d* has a resistor substrate 30 mounted thereon and closes the bottom opening of the cup-like housing member 10*a* with the resistor substrate 30 positioned inside the housing 10. A worm gear 15 is rotatably, but axially nonmovably retained by the peripheral wall 10*b* with teeth of the gear 15 extending inside the housing 10 for engagement with the teeth 21 of a spur gear 20. The spur gear 20 is rotatably accommodated in a circular cavity 11 formed in the top wall 10c so that, when the worm gear 15 is rotated in either of the opposite directions about the longitudinal axis thereof, the spur gear 20 will rotate in a plane orthogonal to the worm gear 15 about a bearing projection 12 formed in the top wall 10*c*. The projection 12 protrudes coaxially into the circular cavity 11 and rotatably engages a bearing recess 22 coaxially formed in the spur gear 20.

Figure 3:
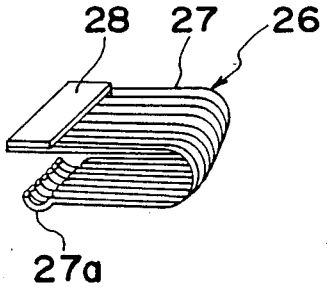
FIG. 3 is a perspective view, on a further enlarged scale, of a resilient wiper assembly used in the potentiometer.

At one side of the spur gear 20 opposite to the top wall 10*c*, the spur gear 20 is formed with a retaining pocket 23 of generally square shape for the support of a wiper assembly 26 of a structure best shown in FIG. 3. The wiper assembly 26 comprises a plurality of generally U-shaped, juxtaposed electroconductive strips 27 rigidly bonded at one end to a metal plate 28 and curled at the other end to provide respective wiper contacts 27*a*. This wiper assembly 26 is retained within the pocket 23 in the spur gear 20 for rotation together with the spur gear 20 and is so interposed between the spur gear 20 and the resistor substrate 30 that the spur gear 20 can be biased upwardly, as viewed in FIG. 2, towards the top wall 10*c* of the housing 10 by the action of the composite resiliency of the juxtaposed electroconductive strips 27. During the rotation of the spur gear 20 accompanied by the corresponding angular movement of the wiper assembly 26 about the axis of rotation of the spur gear 20, the wiper contacts are urged towards the resistor substrate 30 by the action of the composite resiliency of the strips 27. Strips 27 slide in contact with a ring-shaped collector electrode 31, formed on the substrate 30, and a resistance element 32, also formed on the substrate 30, which is concentric with the collector electrode 31 and positioned radially outwardly of the collector electrode 31. As the wiper assembly 26 moves slidingly over the electrode 31 and the resistance element 32, the value of resistance between a second terminal pin 33, connected with the collector electrode 31, and one of the first and third terminal pins 34 and 35 connected with the opposite ends of the resistance element 32 varies.

As shown in FIGS. 4 to 7, the spur gear 20 employed in the present invention is of such a design that some of the teeth 21 of the spur gear 20 are removed, leaving a pair of adjoining blank bases 25*a* and 25*b* that are inclined relative to each other so as to converge radially outwardly of the spur gear 20 and that are integrally provided with respective circumferentially extending ridges 24*c* and 24*d* on respective sides of the apex area delimited by the adjoining blank bases 25*a* and 25*b*. Each of the ridges 24*c* and 24*d* has one side which is flush with one face of the spur gear 20 where the retaining recess 23 is formed and the other side inclined towards the corresponding blank bases 25*a* or 25*b* to provide a respective tapered face 24*a* or 24*b*. It is to be noted that the blank bases 25*a* and 25*b* are so located on the spur gear 20 as to correspond in position to the opposite ends of the resistance element 32 on the substrate 30. As a result, when the spur gear 20 is rotated in either of the opposite directions about the bearing projection 12 in response to the rotation of the worm gear 15, and the wiper assembly 26 is consequently brought to one of the opposite ends of the resistance element 32, the associated blank base 25*a* or 25*b* is brought into registry with some of the teeth of the worm gear 15 while the remaining teeth of the worm gear 15 are disengaged from the spur gear 20.

As best shown in FIG. 8*a*, the teeth 21*a* and 21*b* of the spur gear 20 which are located adjacent to and, hence, immediately follow the respective blank bases 25*a* and 25*b*, are partially cut away to provide radially inwardly setback regions 36*a* and 36*b*, respectively. The teeth 21*a* and 21*b* have their tooth crests preferrably inclined towards the associated blank bases 25*a* and 25*b* as indicated by 37*a* and 37*b*, respectively, in FIGS. 5, 8*a* and 8*b*. It will readily be seen that, as best shown in FIG. 8*b*, with the tooth crest 37*a* or 37*b* of each tooth 21*a* or 21*b* inclined as described, one of the opposite tooth surfaces of the respective tooth 21*a* or 21*b* adjacent the associated blank base 25*a* or 25*b* has a height indicated by h1, measured from the bottom land in a direction radially outwardly of the spur gear 20 whereas the other of the opposite tooth surfaces of such respective tooth 21*a* or 21*b* remote from the associated blank base 25*a* or 25*b* has a height h2 greater than the height h1.

While the potentiometer embodying the present invention is constructed as herein before described, it operates in the following manner.

Figure 9A:
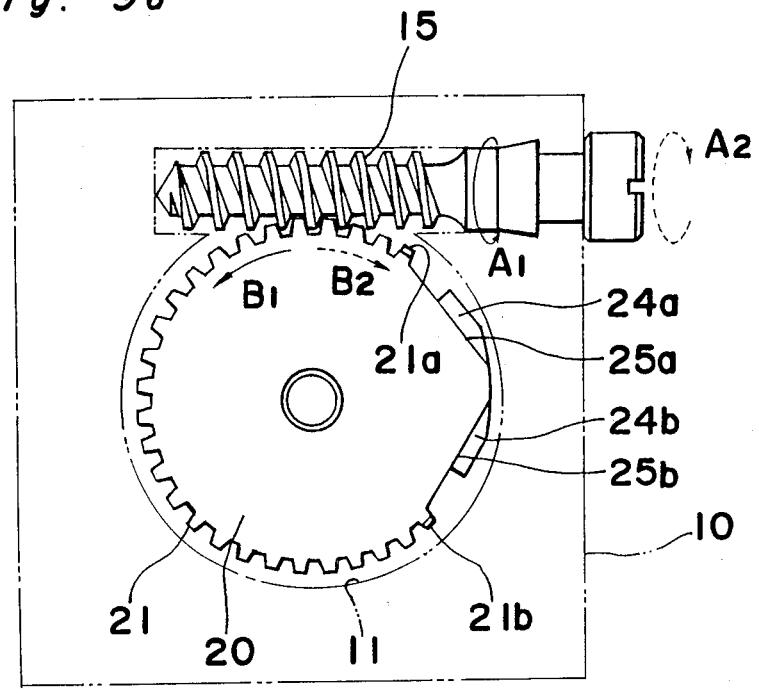
FIGS. 9*a* to 9*e* are schematic top plan views showing different positions of the spur gear relative to the worm gear during the sequential operation of the potentiometer.
Figure 9B:
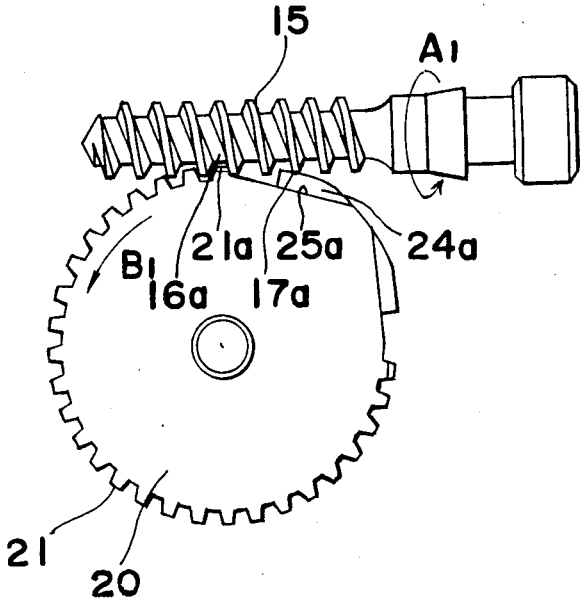
Figure 9C:
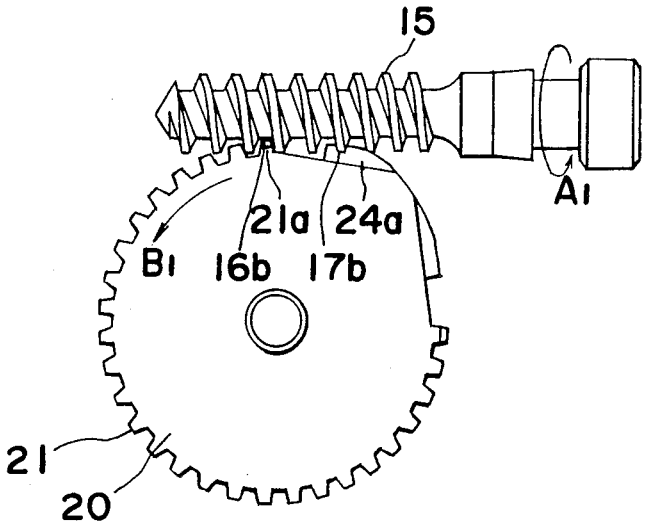
Figure 9D:
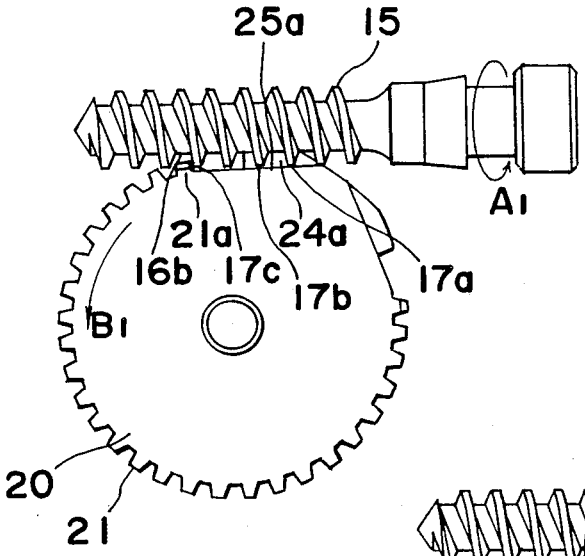
Figure 9E:
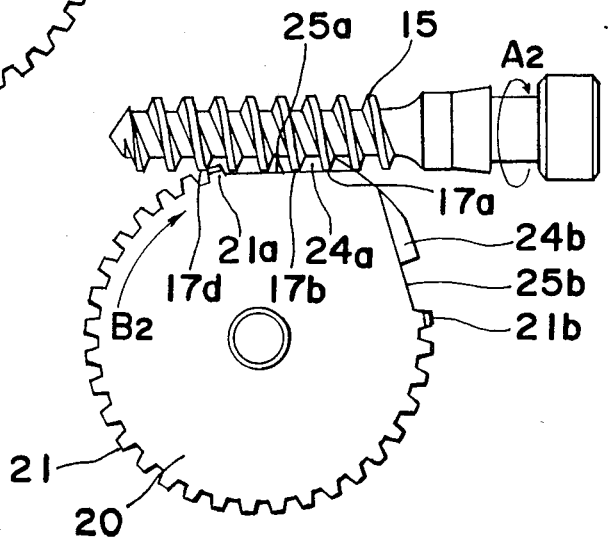
Figures 10A, 10B, 10C, 10D:
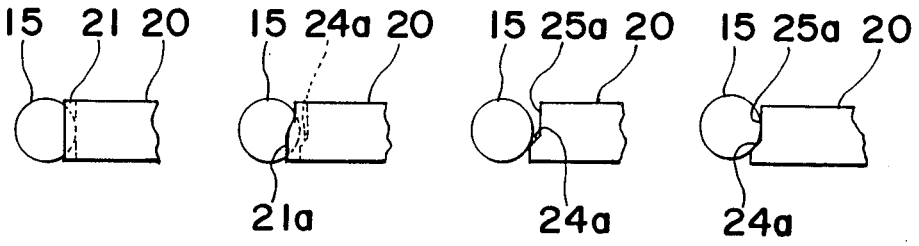
FIGS. 10*a* to 10*d* are schematic explanatory diagrams showing different positions of one end tooth of the spur gear relative to the worm gear.
Figure 11:
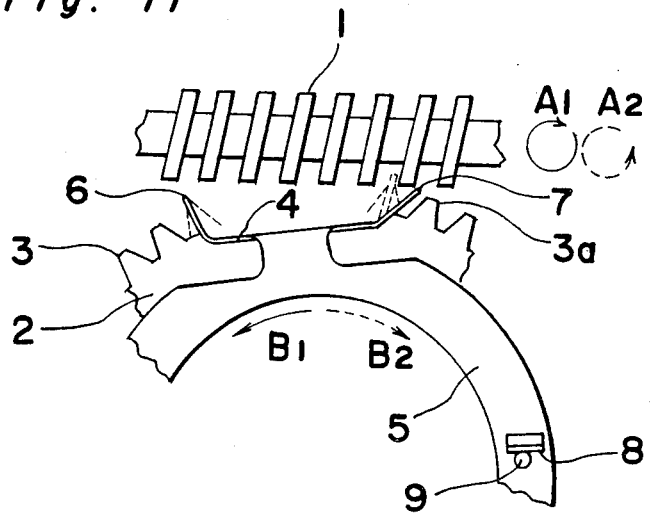
FIG. 11 is a partial side view of a stop mechanism used in the prior art potentiometer.
Figure 12:
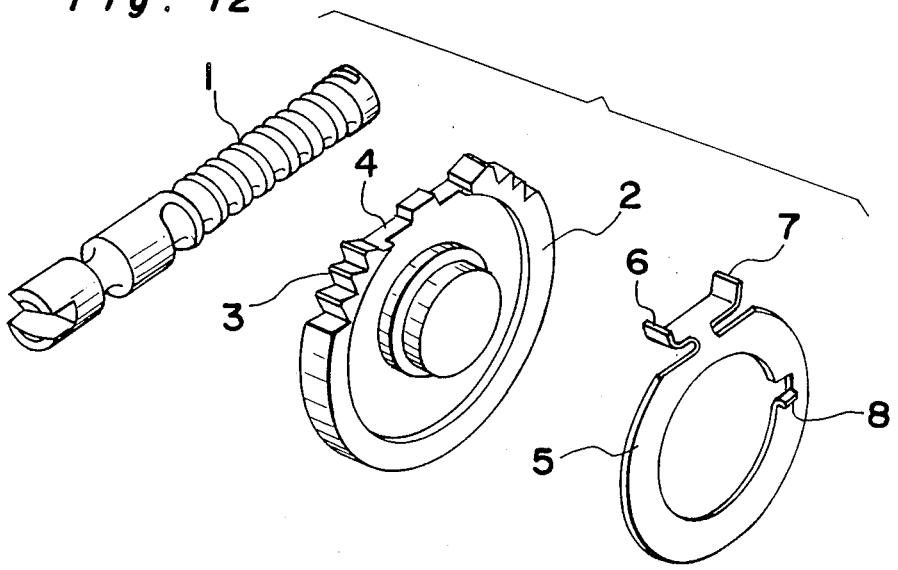
FIG. 12 is an exploded view of the stop mechanism shown in FIG. 11.

During the normal use of the potentiometer, the spur gear 20 is normally urged upwards as viewed in FIG. 2 by the resiliency of the wiper assembly 26 with some of the teeth 21 of the spur gear 20 engaged completely with the worm gear 15 as best shown in FIGS. 9*a* and 10*a*. When the worm gear 15 is turned in a direction shown by the arrow A1, the spur gear 20 is rotated counterclockwise as viewed in FIG. 9, i.e., in a direction shown by the arrow B1. When the worm gear 15 is turned in a direction shown by the arrow A2, the spur gear 20 is rotated clockwise, i.e., in a direction shown by the arrow B2. As the spur gear 20 is so rotated, the wiper assembly 26 rotates together with the spur gear 20 and is ultimately brought into registry with the respective end of the resistance element 32, depending on the direction of rotation of the spur gear 20. As the worm gear 15 is rotated, the resistance between the terminal pin 33 and the terminal pin 34 or between the terminal pin 33 and the terminal pin 35 varies.

When the spur gear 20 is rotated, for example, the direction B1 (as a result of the rotation of the worm gear 15 in the direction A1), the wiper assembly 26 is ultimately brought into a position spaced a very slight distance from one of the opposite ends of the resistance element 32. When the tooth 21*a* of the spur gear 20 adjacent the blank base 25*a* is therefore engaged in one of the spaces between the neighbouring teeth of the worm gear 15 (identified as 16*a* in FIG. 9*b*), the associated tapered face 24*a* is brought into contact with a tooth crest 17*a* of one of the teeth of the worm gear 15 (see FIG. 10*b*). When the worm gear 15 is further turned in the direction A1 until the tooth 21*a* is actually engaged in another one of the spaces (16*b* in FIG. 9*c*) between the neighbouring teeth 21, the tapered face 24*a* is brought into contact with a tooth crest 17*b* (FIG. 10*c*) of another one of the teeth of the worm gear 15.

The clutch releasing procedure or unclutching procedure starts from the condition shown in FIGS. 9*c* and 10*c*. Starting from the condition shown in FIGS. 9*c* and 10*c*, when the worm gear 15 is rotated in direction A1, the spur gear 20 is rotated slightly in the direction B1 with the tooth 21*a* pressed downwardly as viewed in FIG. 2 by the tooth crest 17*c* (FIG. 9*d*) of the worm gear 15 against the resiliency of the wiper assembly 26. As the spur gear 20 is rotated further, the tapered face 24*a* will be pressed downwardly by the tooth crests 17*a* and 17*b* (See FIG. 10*d*) and tooth crest 17*c* of the worm gear 15 will be engaged into the associated setback region 36*a* (FIG. 8*a*) in the tooth 21*a*, permitting the worm gear 15 to disengage from the spur gear 20. Therefore, further rotation of the worm gear 15 in the direction A1 will no longer be transmitted to the spur gear 20 with the wiper assembly 26 held still in contact with one of the opposite ends of the resistance element 32.

Since the tooth 21*a* of the spur gear 20 has its tooth crest inclined as indicated by 37*a* in FIG. 8*b* with the height h1 of one tooth surface thereof being smaller than the height h2 of the opposite tooth surface thereof, the tooth crest 17*c* of the worm gear 15 can be readily disengaged upon the downward displacement of the spur gear 20 against the resiliency of the wiper assembly 26.

The blank base 25*a* in the spur gear 20, when held in contact with the tooth crests 17*a* and 17*b* of the worm gear 15, serves to prevent the spur gear 20 (then unclutched) from being further rotated in the direction B1 by the effect of a force of friction between the tapered face 24*a* and the tooth crests 17*a* and 17*b* which would occur when the worm gear 15 is continuously turned, or under the influence of vibration or impact externally applied to the potentiometer.

It is to be noted that, when the worm gear 15 is turned in the opposite direction A2 starting from the unclutched condition as hereinabove described, the spur gear 20 is self-rotated in the reverse direction B2 while upwardly urged by the resiliency of the wiper assembly 26 with the tapered face 24*a* sliding relatively along the tooth crests 17*a* and 17*b* and, at the same time, because of the height h2 greater than the height h1, the tooth 21*a* is engaged with a tooth crest 17*d* of the worm gear 15 thereby transmitting the rotation of the worm gear 15 to the spur gear 20 to rotate the latter in the reverse direction B2 as shown in FIG. 9*e*. Thus, the teeth 21 of the spur gear 20 are successively engaged with the worm gear 15 in a manner substantially reverse to that shown in and described sequentially with reference to FIGS. 9*b*, 9*c* and 9*d*. Consequently, the further rotation of the spur gear 20 in the direction B2 as a result of the further turn of the worm gear 15 in the direction A2 brings the wiper assembly 26 to the other of the opposite ends of the resistance element 32 with the tapered face 24*b*, the blank base 25*b*, and the tooth 21*b* with the inclined tooth crest 37*b* and the setback region 36*b* functioning in place of, and in respective manners similar to, the tapered face 24*a*, the blank base 25*a*, and the tooth 21*a* with the inclined tooth crest 37*a* and the setback region 36*a*.

From the foregoing description, it has now become clear that since the spur gear retaining the wiper assembly for rotation together therewith is formed with tapered faces which provide a clutch mechanism, the necessity of using a ratchet spring member as employed in the prior art potentiometer is eliminated and, therefore, there is no need to provide the fabricating process with a process step to mount the ratchet spring member into the spur gear. Accordingly, not only can the cost of fabricating as well as that of the component parts be reduced, but also the potentiometers according to the present invention can be manufactured at a relatively high yield.

Moreover, since the spur gear is so formed at its toothless area with the blank bases which define a stopper means for stopping rotation of the spur gear at the time of unclutching, no extra space for the provision of the stopper means is required and no use of the projections such as employed in the prior art potentiometer so as to protrude axially of the spur gear is also needed. As a result, the potentiometer of the present invention can be manufactured compactly with a minimum number of the component parts and, in particular, the thickness thereof can be reduced as compared with that of the prior art potentiometer.

Furthermore, since the respective teeth of the spur gear adjacent the blank bases are formed with the setback regions, respectively, for facilitating the disengagement of the spur gear from the worm gear as to provide a clutch mechanism, the transmission of motion from the worm gear to the spur gear as well as the interruption of such motion transmission can assuredly take place with the clutch mechanism functioning assuredly.

Although the present invention has fully been described in connection with the preferred embodiment with reference to the accompanying drawings, it is to be noted that various changes and modifications are apparent to those skilled in the art. By way of example, although in the illustrated embodiment the spur gear has been shown and described as formed with the blank bases 25*a* and 25*b* forming the stopper means, any other stopper means may be employed. One of such other stopper means may includes the provision of an arcuate groove in one of the opposite surfaces of the spur gear and a projection in the housing 10 for engagement in the arcuate groove so that, when the wiper assembly is brought to a position in register with one of the opposite ends of the resistance element, the projection integral or rigid with the housing can be brought into abutment with one of the opposite ends of the arcuate groove.

In addition, although in the illustrated embodiment the spur gear has been shown and described as formed with a pair of the tapered faces 24*a* and 24*b* and a pair of the setback regions 36*a* and 36*b* so that when the wiper assembly 26 has been moved to one of the opposite ends of the resistance element 32 the clutch can be operated, it may have only one of the tapered faces together with only one of the setback regions, in which case the clutch can be operated only when the wiper assembly is moved to either end of the resistance element.

Furthermore, the resistance element 32 may be in the form of a film formed on the substrate 30, or in the form of a resistance coil. The first to third terminal pins 34, 33 and 35 may be substituted by respective lead wires or any other suitable lines.

Figure 13A:
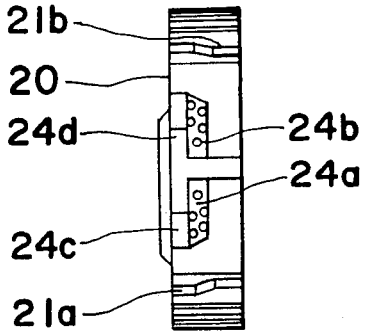
FIGS. 13*a* and 13*b* are side and top plan views, respectively, of the spur gear in a first modified form.
Figure 13B:
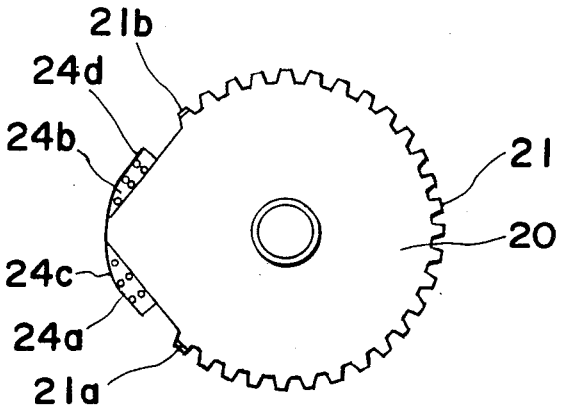
Figure 14A:
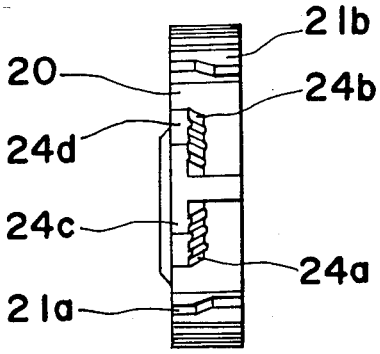
FIGS. 14*a* and 14*b* are views similar to FIGS. 13*a* and 13*b*, respectively, showing the spur gear in a second modified form.
Figure 14B:
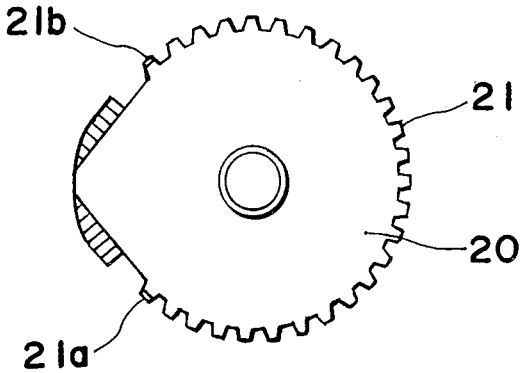
Figure 15A:
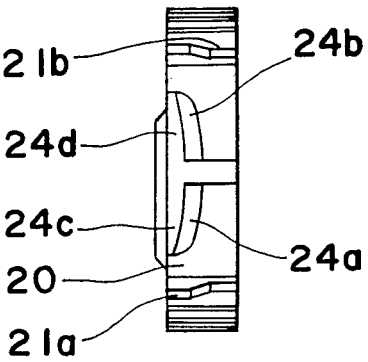
FIGS. 15*a* and 15*b* are views similar to FIGS. 13*a* and 13*b*, respectively, showing the spur gear in a third modified form.
Figure 15B:
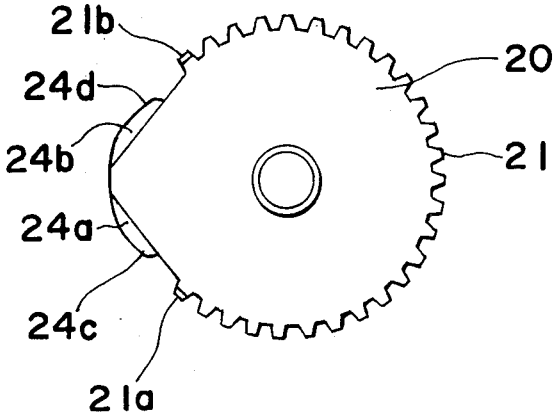

Also, for ensuring the exact engagement between the worm gear 15 and the spur gear 20, each of the tapered faces 24*a* and 24*b* may have a plurality of projections as shown in FIGS. 13*a* and 13*b*, or a plurality of teeth as shown in FIGS. 14*a* and 14*b*. Alternatively, each of the tapered faces may be curved as shown in FIGS. 15*a* and 15*b*. Where the modified design such as shown in FIGS. 13*a* and 13*b*, FIGS. 14*a* and 14*b*, or FIGS. 15*a* and 15*b* is employed for each of the tapered faces 24*a* and 24*b*, the further rotation of the worm gear in the direction A1 subsequent to the unclutching does not result in the rotation of the spur gear further in the direction B1 because the tooth crests of the worm gear 15 have been brought into abutment with the blank base 25*a* while the spur gear 20 undergoes a rattling motion in a direction axially thereof with the projections riding over the worm gear 15. However, when the worm gear 15 is further rotated in the direction A1 subsequent to the unclutching, the tooth crests of the worm gear 15 presses the projections on the associated tapered face 24*a* downwards to displace the spur gear 20 against the resiliency of the wiper assembly 26, overriding the projections.

Accordingly, unless departing from the scope of the present invention as defined by the appended claims, such changes and modifications are to be understood as included therein.

We claim:

1. A rotary trimmer potentiometer which comprises:

a housing;

a resistance element housed within the housing and having first and second opposite ends;

a spur gear rotatably housed within said housing;

a worm gear mounted in said housing in engagement with said spur gear for rotating the latter when said worm gear is turned;

a resilient wiper means housed within said housing for rotation together with said spur gear and positioned between said spur gear and said resistance element for sweeping contact with said resistance element when said spur gear is rotated between first and second positions corresponding to said first and second ends of said resistance elements, respectively, said resilient wiper means applying a resiliency to said spur gear to urge the latter in one direction generally away from said resistance element; and said spur gear having first and second toothless areas defined at a portion of the toothed periphery thereof which corresponds in position to said first and second opposite ends of said resistance element, respectively, said first and second toothless areas each having a flat portion and a tapered face extending therefrom, said flat portion of said first and second toothless areas cooperating with said worm gear when said spur gear is in said first and second portions, respectively, to define stop elements for limiting the rotary motion of said spur gear, said tapered surfaces of said first and second toothless areas cooperating with said worm gear when said spur gear is in said first and second positions, respectively, to displace said spur gear in a direction opposite to said one direction against the resiliency of said wiper means, said spur gear when so displaced against the resiliency of said wiper means disengaging from said worm gear.

2. A potentiometer as claimed in claim 1 wherein first and second teeth of the spur gear adjacent said first and second toothless areas, respectively, are partially cut away to provide a radially inwardly setback region to facilitate the disengagement of the spur gear from the worm gear upon the displacement of the spur gear against the resiliency of the wiper means.

3. A potentiometer as claimed in claim 2, wherein in said first and second teeth of the spur gear have their tooth crest inclined towards the first and second toothless areas, respectively.

* * * * *